US007066159B2

(12) United States Patent
Ruggiero et al.

(10) Patent No.: US 7,066,159 B2
(45) Date of Patent: Jun. 27, 2006

(54) SYSTEM AND METHOD FOR MULTI-LIFT VALVE ACTUATION

(76) Inventors: Brian Ruggiero, 14 Seneca Dr., East Granby, CT (US) 06026; Zhou Yang, 8 Diggins Ct., South Windsor, CT (US) 06074; Neil Fuchs, 70 Whitebeck Rd., New Hartford, CT (US) 06057; Robb Janak, 63 Simons Pond Rd., P.O. Box 229, Colebrook, CT (US) 06021; Shengqiang Huang, 95 Old Farms Rd., West Simbury, CT (US) 06092

( * ) Notice: Subject to any disclaimer, the term of this patent is extended or adjusted under 35 U.S.C. 154(b) by 0 days.

(21) Appl. No.: 11/059,378

(22) Filed: Feb. 17, 2005

(65) Prior Publication Data

US 2005/0188966 A1 Sep. 1, 2005

Related U.S. Application Data

(60) Provisional application No. 60/544,336, filed on Feb. 17, 2004.

(51) Int. Cl.
*F02M 25/07* (2006.01)
*F01L 13/00* (2006.01)

(52) U.S. Cl. ..... 123/568.14; 123/90.12; 123/322

(58) Field of Classification Search ..... 123/90.4, 123/90.46, 90.12, 90.55, 90.63, 90.56, 321, 123/322, 568.14
See application file for complete search history.

(56) References Cited

U.S. PATENT DOCUMENTS

| | | | | |
|---|---|---|---|---|
| 4,572,114 | A * | 2/1986 | Sickler | 123/21 |
| 4,742,806 | A * | 5/1988 | Tart et al. | 123/322 |
| 5,460,131 | A * | 10/1995 | Usko | 123/321 |
| 5,996,550 | A * | 12/1999 | Israel et al. | 123/322 |
| 6,694,933 | B1 * | 2/2004 | Lester | 123/90.12 |
| 6,883,492 | B1 * | 4/2005 | Vanderpoel et al. | 123/321 |

* cited by examiner

*Primary Examiner*—Andrew M. Dolinar
*Assistant Examiner*—Johnny H. Hoang
(74) *Attorney, Agent, or Firm*—David R. Yohannan; Kelley Drye & Warren LLP

(57) ABSTRACT

A system and method for actuating one or more engine valves to produce an engine valve event is disclosed. The system may comprise: a housing; an accumulator disposed in the housing having a first open end and a second open end; a master piston slidably disposed in a first bore formed in the housing; a valve train element(s) for imparting motion to the master piston; and a slave piston slidably disposed in a second bore formed in the housing, the slave piston in fluid communication with the master piston through a high pressure hydraulic passage, wherein the first open end and the second open end of the accumulator are in communication with the high pressure hydraulic passage to selectively modify the imparted motion.

24 Claims, 5 Drawing Sheets

SYSTEM AND METHOD FOR MULTI-LIFT VALVE ACTUATION

CROSS-REFERENCE TO RELATED PATENT APPLICATION

This application claims priority on U.S. Provisional Patent Application No. 60/544,336, for System and Method for Multi-Lift Valve Actuation, filed on Feb. 17, 2004, the entirety of which is incorporated herein by reference.

FIELD OF THE INVENTION

The present invention relates generally to a system and method for actuating one or more valves in an engine. In particular, the present invention relates to systems and methods for multi-lift actuation of one or more engine valves to produce an engine valve event. In one embodiment, the present invention may be used to provide multi-lift exhaust gas recirculation valve events. Embodiments of the present invention may provide other multi-lift valve events, such as, for example, main valve events (exhaust and/or intake), compression release braking valve events, bleeder braking valve events, and/or other auxiliary valve events.

BACKGROUND OF THE INVENTION

Valve actuation in an internal combustion engine is required in order for the engine to produce positive power, engine braking, and exhaust gas recirculation (EGR). During positive power, one or more intake valves may be opened to admit fuel and air into a cylinder for combustion. One or more exhaust valves may be opened to allow combustion gas to escape from the cylinder. Intake, exhaust, and/or auxiliary valves may also be opened during positive power at various times to recirculate gases for improved emissions.

Engine valve actuation also may be used to produce engine braking and exhaust gas recirculation when the engine is not being used to produce positive power. During engine braking, one or more exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle.

Engine valve(s) may be actuated to produce compression-release braking and/or bleeder braking. An example of a prior art compression release engine brake is provided by the disclosure of Cummins, U.S. Pat. No. 3,220,392 (November 1965), which is incorporated herein by reference. An example of a system and method utilizing a bleeder type engine brake is provided by the disclosure of Assignee's U.S. Pat. No. 6,594,996 (Jul. 22, 2003), a copy of which is incorporated herein by reference.

The basic principles of exhaust gas recirculation (EGR) are also well known. After a properly operating engine has performed work on the combination of fuel and inlet air in its combustion chamber, the engine exhausts the remaining gas from the engine cylinder. An EGR system allows a portion of these exhaust gases to flow back into the engine cylinder. This recirculation of gases into the engine cylinder may be used during positive power operation, and/or during engine braking cycles to provide significant benefits. As used herein, EGR may include brake gas recirculation (BGR), which is the recirculation of gases during engine braking cycles.

During positive power operation, an EGR system is primarily used to improve engine emissions. During engine positive power, one or more intake valves may be opened to admit fuel and air from the atmosphere, which contains the oxygen required to burn the fuel in the cylinder. The air, however, also contains a large quantity of nitrogen. The high temperature found within the engine cylinder causes the nitrogen to react with any unused oxygen and form nitrogen oxides (NOx). Nitrogen oxides are one of the main pollutants emitted by diesel engines. The recirculated gases provided by an EGR system have already been used by the engine and contain only a small amount of oxygen. By mixing these gases with fresh air, the amount of oxygen entering the engine may be reduced and fewer nitrogen oxides may be formed. In addition, the recirculated gases may have the effect of lowering the combustion temperature in the engine cylinder below the point at which nitrogen combines with oxygen to form NOx. As a result, EGR systems may work to reduce the amount of NOx produced and to improve engine emissions. Current environmental standards for diesel engines, as well as proposed regulations, in the United States and other countries indicate that the need for improved emissions will only become more important in the future.

An EGR system may also be used to optimize retarding power during engine braking operation. As discussed above, during engine braking, one or more exhaust valves may be selectively opened to convert, at least temporarily, the engine into an air compressor. By controlling the pressure and temperature in the engine using EGR, the level of braking may be optimized at various operating conditions.

In many systems, it may be desirable to provide multiple valve lifts for an engine valve event. For example, the amount of exhaust gas recirculation desired may increase with engine speed. Thus, when providing an EGR valve event, it may be desirable for the valve lift to be higher and/or longer at higher engine speeds, and lower and/or shorter at slower engine speeds.

In many internal combustion engines, the engine intake and exhaust valves may be opened and closed by fixed profile cams, and more specifically by one or more fixed lobes which may be an integral part of each of the cams. Benefits such as increased performance, improved fuel economy, lower emissions, and better vehicle drivability may be obtained if the intake and exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide valve actuation that incorporates a "lost motion" system in the valve train linkage between the valve and the cam. Lost motion is the term applied to a class of technical solutions for modifying the valve motion prescribed by a cam profile with a variable length mechanical, hydraulic, and/or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve. It is advantageous to provide a system for modifying the motion of a fixed cam profile that may be turned on or off, and selectively controlled based on various conditions.

The systems and methods of the present invention may be particularly useful in engines requiring valve actuation for positive power, engine braking valve events and/or EGR/BGR valve events. The systems and methods of various embodiments of the present invention may provide a lower cost, simpler variable valve actuation system. In addition, the systems and methods of the present invention may provide multiple valve lift profiles to improve engine performance during positive power, engine braking, EGR and/or BGR operation under a variety of engine conditions. Additional advantages of embodiments of the invention are set forth, in part, in the description which follows and, in part, will be apparent to one of ordinary skill in the art from the description and/or from the practice of the invention.

SUMMARY OF THE INVENTION

Responsive to the foregoing challenges, Applicant has developed innovative systems and methods for actuating one or more engine valves. In one embodiment, the system may comprise: a housing; an accumulator disposed in the housing having a first open end and a second open end; a master piston slidably disposed in a first bore formed in the housing; a valve train element(s) for imparting motion to the master piston; and a slave piston slidably disposed in a second bore formed in the housing, the slave piston in fluid communication with the master piston through a high pressure hydraulic passage, wherein the first open end and the second open end of the accumulator are in communication with the high pressure hydraulic passage to selectively modify the imparted motion.

Applicant has further developed a system of actuating one or more engine valves in an internal combustion engine to produce an exhaust gas recirculation engine valve event, the system comprising: a housing; an accumulator disposed in the housing having a first open end and a second open end; a high pressure fluid passage; a master piston slidably disposed in a first bore formed in the housing; means for imparting motion to the master piston; a slave piston slidably disposed in a second bore formed in the housing, the slave piston in fluid communication with the master piston through the high pressure hydraulic passage; a shuttle valve; and a first solenoid valve for controlling the shuttle valve to selectively communicate the first open end and the second open end of the accumulator with the high pressure hydraulic passage, wherein the first open end and the second open end of the accumulator are in selective communication with the high pressure hydraulic passage to selectively modify the imparted motion.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to embodiments of the system and method of the present invention, examples of which are illustrated in the accompanying drawings. As embodied herein, the present invention includes systems and methods of actuating one or more engine valves.

Figure 1:
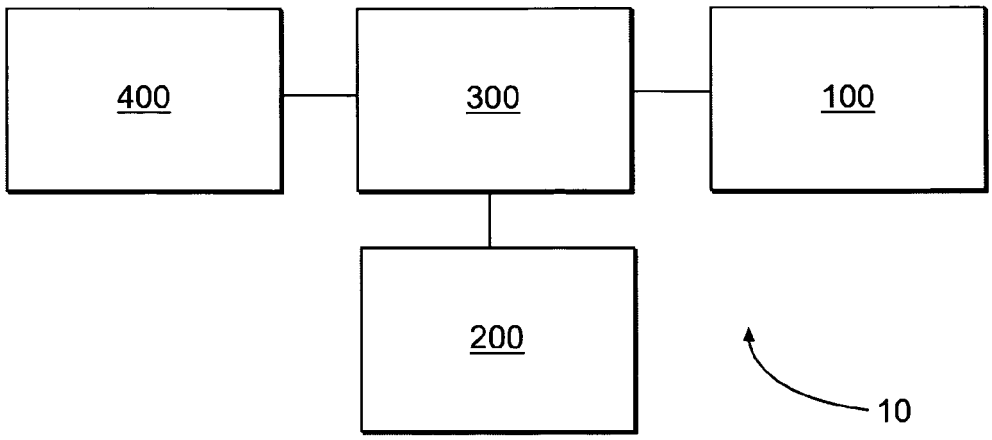
FIG. 1 is a block diagram of a first embodiment of the valve actuation system of the present invention.

A first embodiment of the present invention is shown schematically in FIG. 1 as valve actuation system 10. The valve actuation system 10 includes a means for imparting motion 100 operatively connected to a valve actuator assembly 300, which in turn is operatively connected to one or more engine valves 200. The motion imparting means 100 is adapted to apply motion to the valve actuator 300. The valve actuator 300 may be selectively controlled to transfer or not transfer motion to the engine valve 200.

When in the motion transfer mode, the valve actuator 300 is adapted to actuate the engine valve 200 to produce an engine valve event, such as, but not limited to, main intake, main exhaust, exhaust gas recirculation, compression release braking, and/or bleeder braking. The valve actuator 300 may also modify the amount and timing of the motion transferred to the engine valves 200. In this manner, the valve actuator 300 is adapted to provide multiple valve lift profiles. The valve actuation system 10, including the valve actuator 300, may transfer, not transfer, and/or modify the imparted motion in response to a signal or input from a controller 400. The engine valves 200 may be one or more exhaust valves, intake valves, or auxiliary valves, such as, a dedicated valve.

Figure 2:
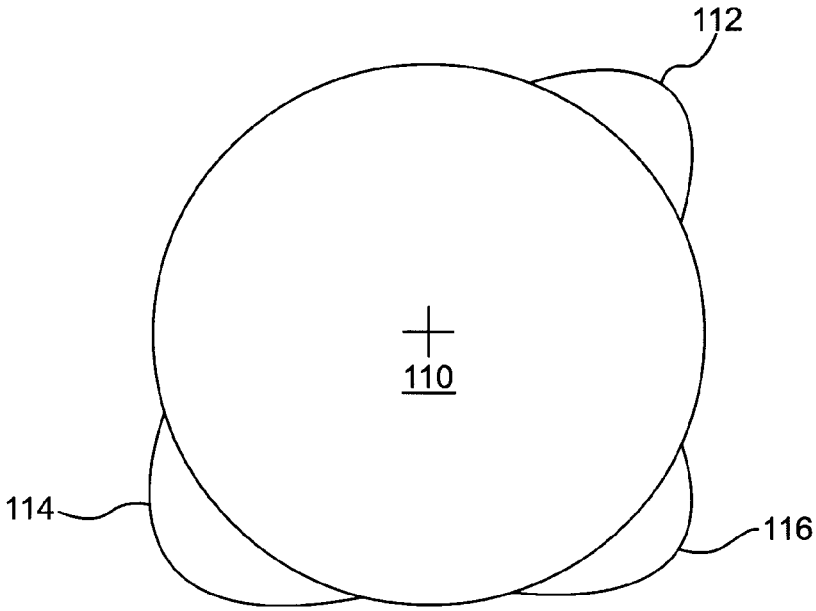
FIG. 2 is a schematic diagram of a cam that may be used in an embodiment of the present invention.

The motion imparting means 100 may comprise any combination of cam(s), push tube(s), and/or rocker arm(s), or their equivalents, adapted to impart motion to the valve actuator 300. In at least one embodiment of the present invention, the motion imparting means 100 comprises a cam 110. The cam 110 may comprise an exhaust cam, an intake cam, an injector cam, and/or a dedicated cam. As shown in FIG. 2, the cam 110 may include one or more cam lobes for producing an engine valve event(s). For example, the cam may include lobes, such as, for example, a main (exhaust or intake) event lobe 112, an engine braking lobe 114, and an EGR lobe 116. The depictions of the lobes on the cam 110 are intended to be illustrative only, and not limiting. It is appreciated that the number, combination, size, location, and shape of the lobes may vary markedly without departing from the scope of the present invention.

The motion imparted by the cam 110 to produce an engine valve main event may be used to provide an EGR valve event. For example, a main event (e.g., intake or exhaust) lobe 112 may be used to additionally actuate one or more valves 200 for an EGR valve event. Because the full motion of the main event may provide more valve lift than required for the EGR valve event, the motion may be modified by the valve actuator 300.

The EGR valve event may be carried out by different valve(s) than those used to carry out the main engine valve event. These "different valves" may be of the same or different type (intake versus exhaust) as those used for the main valve event, and may be associated with a different or the same cylinder as the valves used for the main valve event.

The controller 400 may comprise any electronic or mechanical device for communicating with the valve actuator 300 and causing the valve actuator 300 to either transfer the motion input to it, modify the motion input to it, or not transfer the motion, to the engine valves 200. The controller 400 may include a microprocessor, linked to other engine component(s), to determine and select the appropriate operation of the valve actuator 300. EGR may be achieved and optimized at a plurality of engine operating conditions (e.g., speeds, loads, etc.) by controlling the valve actuator 300 based upon information collected by the microprocessor from the engine component(s). The information collected may include, without limitation, engine speed, vehicle speed, oil temperature, manifold (or port) temperature, manifold (or port) pressure, cylinder temperature, cylinder pressure, particulate information, and/or crank angle.

A second embodiment of the present invention will now be described with reference to FIG. 3. The valve actuator 300 comprises master piston assembly 310 slidably disposed in a first bore 311 formed in a housing 302 such that it may slide back and forth in the bore while maintaining a hydraulic seal with the housing 302. The valve actuator 300 further includes a slave piston assembly 320 disposed in a second bore 321 formed in the housing 302 such that it may slide back and forth in the bore while maintaining a hydraulic seal with the housing 302. The slave piston assembly 320 is in fluid communication with the master piston assembly 310 through a hydraulic passage 304 formed in the housing 302. A spring 322 biases the slave piston 320 upward in the bore 321, away from the engine valve 200. The spring 324 holds the slave piston 320 up against any low hydraulic pressure in the passage 304 that may be acting on the piston. This prevents the slave piston assembly 320 from "jacking," a condition which can cause damage to the system.

The valve actuator 300 may further comprise a fluid supply valve, such as, a solenoid valve 330 disposed in a low-pressure hydraulic passage 306 formed in the housing 302. The first solenoid valve 330 may selectively supply hydraulic fluid from a fluid supply means (not shown) through the low-pressure passage 306 to the passage 304 in response to a signal received from the controller 400. A first check valve 332 may be disposed in the low-pressure passage 306 so as to primarily allow only one-way fluid flow from the low-pressure passage 306 to the passage 304. In alternative embodiments, the check valve 332 may comprise, for example, a control valve, or other type of valve adapted to primarily allow only one-way fluid flow from the low-pressure passage 306.

The valve actuator may further comprise a solenoid valve 350 in communication with a control valve 355. The control valve 355 may comprise, for example, a spool valve, a shuttle valve, or another valve capable of being operated between a plurality of positions. The solenoid valve 350 may operate the control valve 355 between a first position, as shown in FIG. 3, and a second position, in response to a signal received from the controller 400.

The valve actuator 300 further comprises an accumulator 340 having a first open end 342 and a second open end 344. A stroke-limiting accumulator spring 346 is disposed between the first open end 342 and the second open end 344. The specifications of the spring 346, for example, when it bottoms out, may be adjusted based on system requirements. In the embodiment of the present invention shown in FIG. 3, the first end 342 is in communication with an accumulator passage 308, and the second end 344 is in communication with ambient pressure.

Figure 3:
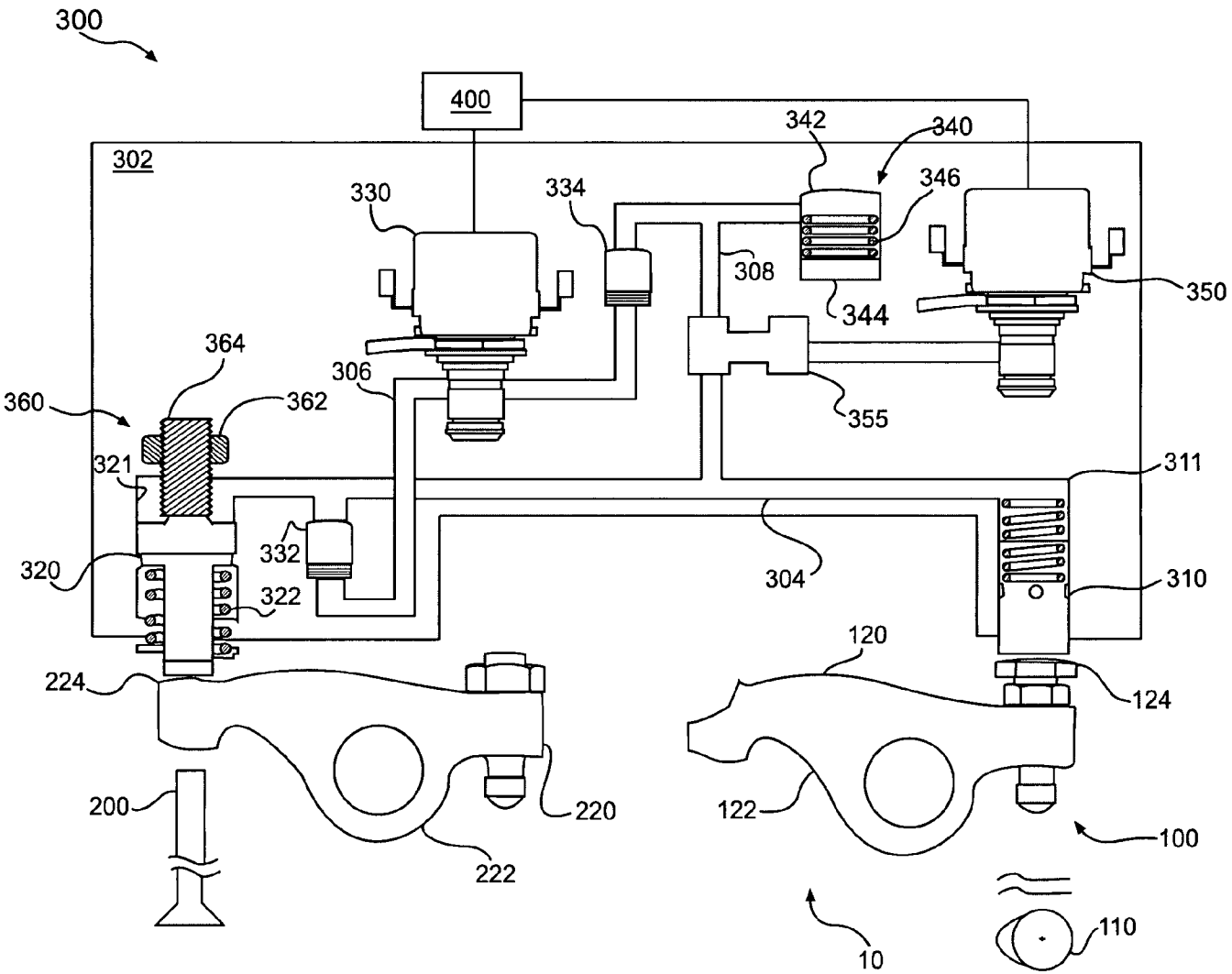
FIG. 3 is a schematic diagram of a second embodiment of the valve actuation system of the present invention.

In the valve actuator 300 embodiment shown in FIG. 3, the motion imparting means 100 includes a rocker arm 120 having a central opening 122 for receiving a rocker shaft, and a contact surface 124 for contacting the master piston 310. The rocker arm 120 may be operatively connected to the cam 110 such that the motion of the cam 110 is imparted through the rocker arm 120 to the master piston 310.

In the valve actuator 300 embodiment shown in FIG. 3, the slave piston 320 may act on a rocker arm 220, which in turn, acts on the one or more engine valves 200. The rocker arm 220 includes a central opening 222 for receiving a rocker shaft, and a contact extension 224 for contacting the slave piston 320 and the valve 200. In alternative embodiments of the present invention, it is contemplated that the slave piston 320 may act on a pin slidably disposed in the contact extension 224, or on the engine valve 200 directly. In still another alternative embodiment, the slave piston may act on a plurality of engine valves 200, through, for example, a valve bridge.

As discussed above, the cam and the rocker arm 120 may be a different "type" (e.g., intake versus exhaust), and from the same or different cylinder than the rocker arm 220 and the valve 200. For example, in a multi-cylinder engine, the rocker arm 120 may comprise an intake rocker arm from a first cylinder, and the rocker arm 220 may comprise an exhaust rocker arm from the first cylinder. This arrangement may be useful in providing an appropriately timed valve event, such as, for example, an exhaust gas recirculation event during the main intake event.

In one embodiment of the present invention, the valve actuator 300 may further comprise a lash assembly 360 disposed above the slave piston 320. The lash assembly 360 comprises an adjustable screw 364 extending into the slave piston bore 321, and a locking nut 362. The locking nut 362 may be adjusted to extend the screw 364 a desired distance within the bore 321 to adjust any lash that may exist between the slave piston 320 and the rocker arm 220.

Operation of the valve actuator 300 shown in FIG. 3 will now be described. For illustrative purposes, operation of the valve actuator 300 will be described in connection with producing an EGR engine valve event. As discussed above, the valve actuator 300 may be operated as described to provide other engine valve events.

Figure 6A:
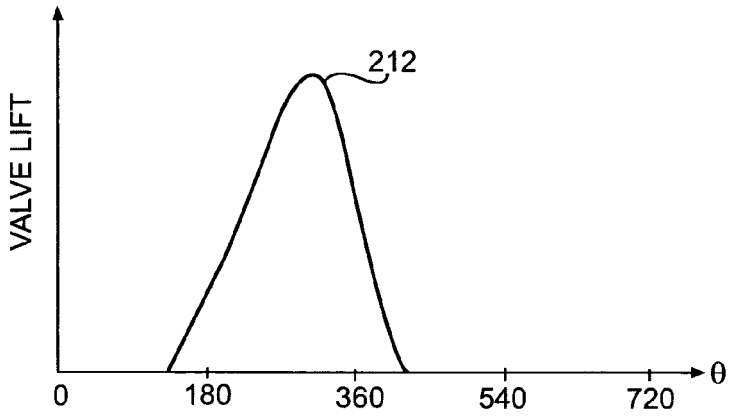
FIG. 6*a*–FIG. 6*c* are valve lift diagrams according to the valve actuation system of the present invention.

When EGR is not required, the solenoid valve 330 is not activated. As a result, no hydraulic fluid is supplied to the passage 304. Because there is insufficient hydraulic pressure in the passage 304, the motion of the master piston 310 is not transferred to the slave piston 320. Correspondingly, the slave piston 320 does not act on the engine valve 200 and no engine valve event is produced. The resulting valve lift diagram is shown in FIG. 6*a*, wherein only the main exhaust event 212 occurs.

Figure 6B:
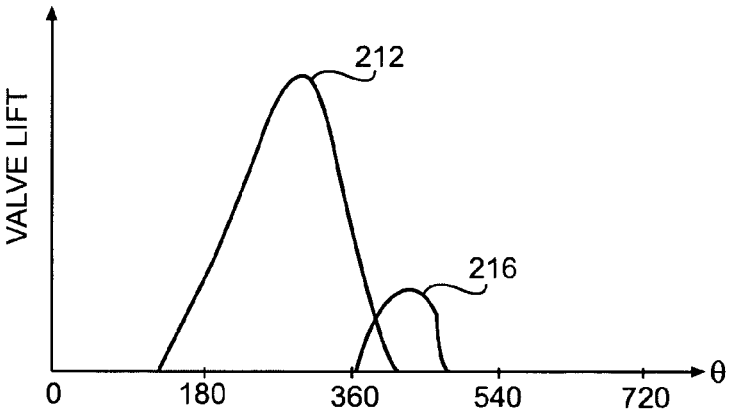

When an EGR event is desired, the solenoid valve 330 may operate in response to a signal from the controller 400 to provide low-pressure hydraulic fluid to the passage 304. As motion is imparted to the master piston 310, the master piston 310 moves upward within the bore 311. The master piston motion is transferred through the hydraulic pressure in the passage 304 to the slave piston 320. This causes the slave piston 320 to translate in a downward direction, resulting in actuation of the engine valve 200. When the control valve 355 is in its first position, as shown in FIG. 3, the hydraulic fluid pressure in the passage 304 is prevented from communicating through the passage 308 to the accumulator 340. Accordingly, all of the motion imparted to the master piston 310 is transferred to the slave piston 320, and a full-lift EGR valve event 216 is produced, as shown, for example, in FIG. 6*b*.

Figure 6C:
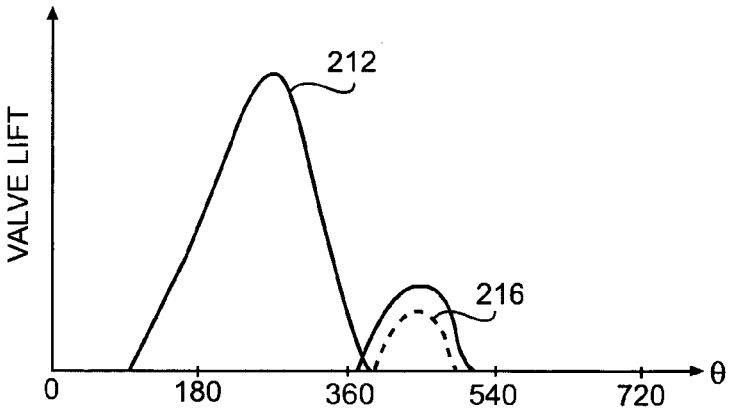

When a lower lift engine valve event is desired, the motion imparted to the master piston 310 may be modified. In response to a signal from the controller 400, the solenoid 350 may operate the control valve 355 into its second position. In this position, hydraulic fluid pressure in the passage 304 may now communicate through the passage 308 to the first open end 342 of the accumulator 340. The hydraulic pressure in the passage 304 is sufficient to overcome the bias of the accumulator spring 346. Accordingly, as motion is imparted to the master piston 310, the hydraulic pressure in the passage 304 is absorbed by the accumulator spring 346 rather than transferred to the slave piston 320. The accumulator 340 absorbs the motion until the spring 346 reaches a mechanical stop within the accumulator. At this point, the remaining motion imparted to the master piston 310 is transferred to the slave piston 320, and the valve 200. The result is a modified lift EGR valve event 216, as shown, for example, in FIG. 6*c*.

In one embodiment of the present invention, as shown in FIG. 3, a second check valve 334 may be disposed in the low-pressure passage 306. When the solenoid valve 330 is activated to provide low-pressure fluid to the passage 304, hydraulic fluid may also flow through the check valve 334 to the first end of the accumulator 342. When the control valve 355 is in its second position and high pressure fluid is provided through the passage 308, the presence of the low-pressure oil may facilitate transfer of the high pressure fluid to the accumulator 340. This may result in improved response time for the system 10. Because the low-pressure fluid itself is insufficient to overcome the bias of the accumulator spring 346, the stroke of the accumulator 340 is not affected when modified motion is not required. The check valve 334 may allow primarily one-way fluid flow such that the high-pressure fluid provided through the passage 308 does not flow into the low-pressure passage 306.

Figure 4:
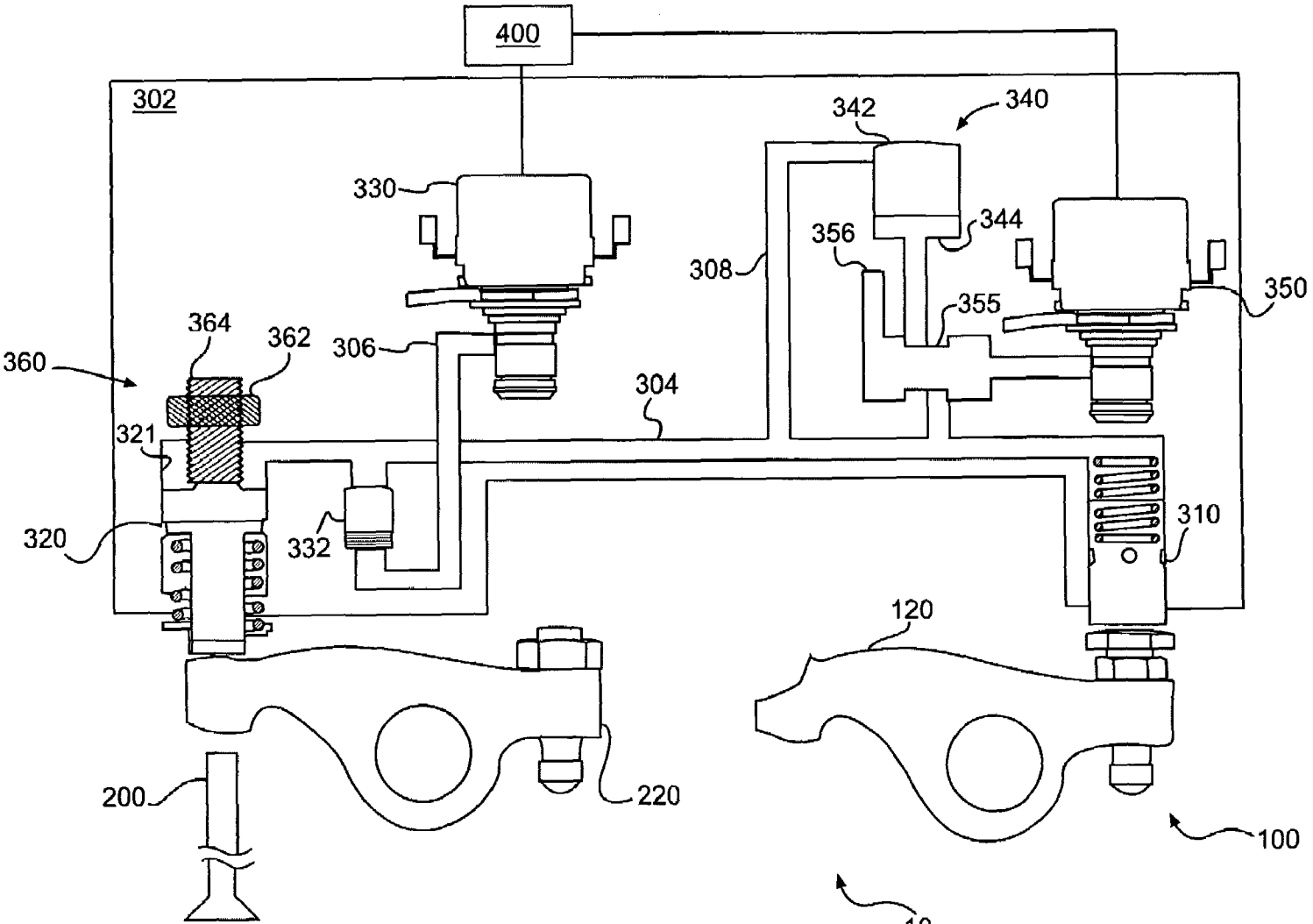
FIG. 4 is a schematic diagram of a third embodiment of the valve actuation system of the present invention.

Another embodiment of the valve actuator 300 is shown with reference to FIG. 4, in which like reference characters refer to like elements. The first end 342 of the accumulator 340 is in constant communication with the passage 304 through the passage 308. The control valve 355 may be operated between a first position, as shown in FIG. 4, in which the second end 344 of the accumulator 340 communicates with ambient through an opening 356 in the control valve 355; and a second position, in which the second end 344 of the accumulator 340 communicates with the passage 304. When the control valve 355 is in its first position, the high pressure hydraulic fluid in the passage 304 may communicate through the passage 308 to the first open end 342 of the accumulator 340. Because the pressure at the second end 344 of the accumulator 340 is ambient, the high pressure from the passage 308 is sufficient to overcome the bias of the accumulator spring. Accordingly, as motion is imparted to the master piston 310, the hydraulic pressure in the passage 304 is absorbed by the accumulator 340 rather than transferred to the slave piston 320. The result is a modified lift EGR valve event 216, as shown, for example, in FIG. 6*c*.

When the control valve 355 is in its second position, the high pressure hydraulic fluid in the passage 304 may communicate through the passage 308 to the first open end 342 of the accumulator 340, and to the second open end 344 of the accumulator 340. The pressure at the second end 344 of the accumulator 340 is now substantially equal to the high pressure at the first end 342. Because of the lack of pressure differential, the accumulator spring 346 does not actuate. Accordingly, as motion is imparted to the master piston 310, the hydraulic pressure in the passage 304 is not absorbed by the accumulator 340, and the complete motion is transferred to the slave piston 320. The result is a full-lift EGR valve event 216, as shown, for example, in FIG. 6*b*.

Figure 5:
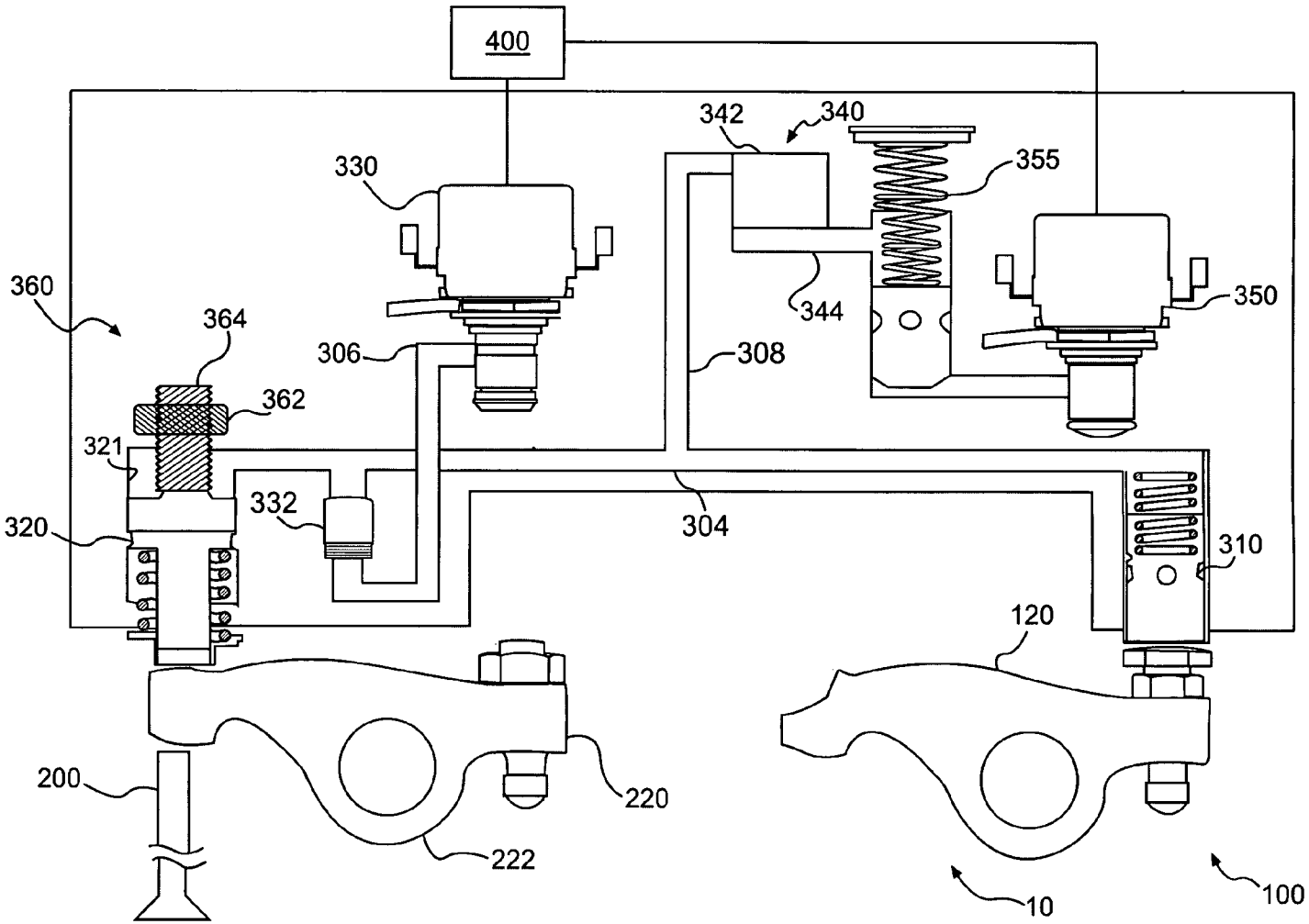
FIG. 5 is a schematic diagram of a fourth embodiment of the valve actuation system of the present invention.

Another embodiment of the valve actuator 300 is shown with reference to FIG. 5, in which like reference characters refer to like elements. The solenoid valve 350 may comprise a high speed fluid supply valve in communication with the fluid supply means. When a full-lift event is required, the solenoid valve 350 may be activated to supply high pressure fluid through the control valve 355 to the second end 344 of the accumulator 340. Because high-pressure is acting on both the first end and the second end of the accumulator 340, the accumulator spring 346 does not actuate and no motion is absorbed. When a modified valve lift is required, the solenoid valve 350 is not activated. The high pressure acting solely on the first end 342 of the accumulator 340 is now sufficient to overcome the bias of the accumulator spring 346, and the accumulator 340 absorbs a portion of the imparted motion.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A system of actuating one or more engine valves in an internal combustion engine to produce an engine valve event, said system comprising:

a housing;

an accumulator disposed in said housing having a first end and a second end;

a master piston slidably disposed in a first bore formed in said housing;

means for imparting motion to the master piston;

a slave piston slidably disposed in a second bore formed in said housing said slave piston being adapted to actuate an engine valve;

a hydraulic passage connecting the master piston and the slave piston and the accumulator;

means for selectively supplying hydraulic fluid to the hydraulic passage; and means for selectively applying hydraulic fluid pressure to at least one of the first end and the second end of the accumulator.

2. The system of claim 1, wherein the engine valve event comprises an exhaust gas recirculation.

3. The system of claim 1, wherein said accumulator comprises a stroke limiting piston disposed between the first end and the second end.

4. The system of claim 1, wherein the means for selectively applying hydraulic fluid pressure to at least one of the first end and the second end of the accumulator comprises:

a shuttle valve; and a solenoid valve.

5. A system of actuating one or more engine valves in an internal combustion engine to produce an engine valve event, said system comprising:

a housing;

an accumulator disposed in said housing having a first open end and a second open end;

a master piston slidably disposed in a first bore formed in said housing;

means for imparting motion to the master piston; and a slave piston slidably disposed in a second bore formed in said housing, said slave piston in fluid communication with said master piston through a high pressure hydraulic passage, wherein the first open end and the second open end of said accumulator are in selective communication with the high pressure hydraulic passage to modify the imparted motion, and wherein the first open end of said accumulator is in communication with the high pressure hydraulic passage and the second open end is in communication with ambient pressure.

6. The system of claim 5, wherein the imparted motion is modified to produce a low lift engine valve event.

7. A system of actuating one or more engine valves in an internal combustion engine to produce an exhaust gas recirculation engine valve event, said system comprising:

a housing;

an accumulator disposed in said housing having a first open end and a second open end;

a high pressure fluid passage;

a master piston slidably disposed in a first bore formed in said housing;

means for imparting motion to said master piston;

a slave piston slidably disposed in a second bore formed in said housing, said slave piston in fluid communication with said master piston through said high pressure hydraulic passage;

a shuttle valve; and a first solenoid valve for controlling said shuttle valve to selectively communicate the first open end and the second open end of said accumulator with said high pressure hydraulic passage, wherein the first open end and the second open end of said accumulator are in selective communication with said high pressure hydraulic passage to selectively modify the imparted motion, and wherein the system further comprises:

a first rocker arm disposed between the one or more engine valves and said master piston; and a second rocker arm disposed between said motion imparting means and said slave piston.

8. A system of actuating one or more engine valves in an internal combustion engine to produce an exhaust gas recirculation engine valve event, said system comprising:

a housing;

an accumulator disposed in said housing having a first open end and a second open end;

a high pressure fluid passage;

a master piston slidably disposed in a first bore formed in said housing;

means for imparting motion to said master piston;

a slave piston slidably disposed in a second bore formed in said housing, said slave piston in fluid communication with said master piston through said high pressure hydraulic passage;

a shuffle valve; and a first solenoid valve for controlling said shuttle valve to selectively communicate the first open end and the second open end of said accumulator with said high pressure hydraulic passage, wherein the first open end and the second open end of said accumulator are in selective communication with said high pressure hydraulic passage to selectively modify the imparted motion, and wherein the first open end of said accumulator is in communication with said high pressure hydraulic passage and the second open end is in communication with ambient pressure.

9. The system of claim 8, wherein the imparted motion is modified to produce a low lift engine valve event.

10. A system of actuating one or more engine valves in an internal combustion engine to produce an engine valve event, said system comprising:

a housing;

an accumulator disposed in said housing, said accumulator having a first end and a second end;

a master piston slidably disposed in a first bore in said housing;

means for imparting motion to the master piston;

a slave piston slidably disposed in a second bore in said housing;

a hydraulic fluid circuit connecting the master piston, the slave piston and at least one of the first end or the second end of the accumulator;

a hydraulic fluid source;

a first control valve disposed between the hydraulic fluid circuit and the hydraulic fluid source; and a second control valve in hydraulic communication with the accumulator and adapted to selectively place at least one of said first end and said second end of the accumulator in hydraulic communication with a high pressure fluid.

11. The system of claim 10, wherein the first control valve comprises a first solenoid valve.

12. The system of claim 11, wherein the second control valve comprises a second solenoid valve.

13. The system of claim 10, wherein the second control valve comprises a solenoid valve.

14. The system of claim 10, wherein the second control valve is disposed in the hydraulic fluid circuit between the (i) master piston and the slave piston, and (ii) the accumulator.

15. The system of claim 10, wherein the second control valve is disposed in the hydraulic fluid circuit between the (i) master piston and the slave piston, and (ii) the first end of the accumulator.

16. The system of claim 15, wherein the second end of the accumulator communicates with an ambient pressure.

17. The system of claim 10, wherein the second control valve is disposed in the hydraulic fluid circuit between the (i) master piston and the slave piston, and (ii) the second end of the accumulator.

18. The system of claim 17, wherein the hydraulic fluid circuit connects the master piston, the slave piston, the first end of the accumulator, and the second end of the accumulator.

19. The system of claim 10, wherein the second control valve is disposed between the hydraulic fluid source and the second end of the accumulator.

20. The system of claim 10, wherein the second end of said accumulator is in selective hydraulic communication with said high pressure fluid.

21. The system of claim 10, wherein the first end of said accumulator is in selective hydraulic communication with said high pressure fluid.

22. A system for actuating one or more engine valves in an engine, said system comprising:

a hydraulic fluid accumulator having a first end and a second end;

a master piston slidably disposed in a first bore;

a slave piston slidably disposed in a second bore;

a hydraulic circuit connecting the master piston, the slave piston and the first end of the accumulator;

a hydraulic fluid source;

a first control valve connected to the hydraulic fluid source and the hydraulic circuit; and a second control valve disposed in the hydraulic circuit between (i) the first end of the accumulator and (ii) the master piston and the slave piston.

23. A system for actuating one or more engine valves in an engine, said system comprising:

a hydraulic fluid accumulator having a first end and a second end;

a master piston slidably disposed in a first bore;

a slave piston slidably disposed in a second bore;

a hydraulic circuit connecting the master piston, the slave piston and the first end of the accumulator;

a hydraulic passage extending between the hydraulic circuit and the second end of the accumulator; and a control valve disposed in the hydraulic passage.

24. A system for actuating one or more engine valves in an engine, said system comprising:

a hydraulic fluid accumulator having a first end and a second end;

a master piston slidably disposed in a first bore;

a slave piston slidably disposed in a second bore;

a hydraulic circuit connecting the master piston, the slave piston and the first end of the accumulator;

a hydraulic fluid source;

a hydraulic passage connecting the hydraulic fluid source and the second end of the accumulator; and a control valve disposed in the hydraulic passage.

* * * * *